United States Patent [19]

Biass

[11] Patent Number: 4,615,509

[45] Date of Patent: Oct. 7, 1986

[54] CONTINUOUS OPERATION LINEAR HYDRAULIC WINCH

[75] Inventor: David Biass, Geneva, Switzerland

[73] Assignee: Cibeles International Inc., Panama, Panama

[21] Appl. No.: 790,608

[22] Filed: Oct. 23, 1985

[51] Int. Cl.[4] ..... B66F 3/26; B65H 51/18

[52] U.S. Cl. ..... 254/264; 254/228; 254/254

[58] Field of Search ..... 254/199, 201, 228, 251, 254/253, 254, 264, 384

[56] References Cited

U.S. PATENT DOCUMENTS

| | | | |
|---|---|---|---|
| 3,266,776 | 8/1966 | Catu | 254/264 |
| 4,427,180 | 1/1984 | Brieuc | 254/106 |
| 4,448,393 | 5/1984 | Habegger | 254/264 |
| 4,456,226 | 6/1984 | Stumpmeier | 254/228 X |

FOREIGN PATENT DOCUMENTS

| | | | |
|---|---|---|---|
| 795195 | 9/1968 | Canada | 254/264 |
| 1255269 | 11/1967 | Fed. Rep. of Germany | 254/264 |
| 119552 | 7/1983 | Japan | 254/264 |
| 1186244 | 4/1970 | United Kingdom | 254/264 |

*Primary Examiner*—Stuart S. Levy
*Assistant Examiner*—Joseph J. Hail, III

[57] ABSTRACT

A continuous operation linear hydraulic winch comprising a fixed frame, a first gripping assembly, a first pair of hydraulic jacks mounted between the frame and the first gripping assembly, a second gripping assembly and a second pair of hydraulic jacks mounted between the frame and the second gripping assembly, wherein the frame comprises a single bearing plate perpendicular to the jacks, the first gripping assembly is disposed on one side of the bearing plate and the second gripping assembly on the other side of the bearing plate, the first and second pairs of hydraulic jacks having one of their cylinders and piston rods connected to the bearing plate and the other of their cylinders and piston rods connected to a respective one of the first and second gripping assemblies.

14 Claims, 12 Drawing Figures

CONTINUOUS OPERATION LINEAR HYDRAULIC WINCH

BACKGROUND OF THE INVENTION

1. Field of the Invention

The invention relates to a continuous operation linear hydraulic winch of the type comprising a fixed frame, a first gripping assembly, a first pair of parallely disposed hydraulic jacks mounted between the frame and the first gripping assembly, a second gripping assembly, and a second pair of parallely disposed hydraulic jacks extending in a same direction as said first pair of jacks and mounted between the frame and the second gripping assembly.

2. Description of the Prior Art

Linear hydraulic winches are well known. They are either of the intermittent operation type (see U.S. Pat. No. 4,427,180) or of the continuous operation type (see FIG. 1 of the accompanying drawings which shows schematically such a continuous operation winch). For equal tractive forces and equal strokes of the hydraulic jacks, the known continuous operation winches have the drawback of being greater in length than intermittent operation winches. That is due to the fact that in continuous operation winches the two gripping assemblies are mounted for movement in the frame of the winch, and to the fact that an additional pair of hydraulic jacks is provided for moving that one of the two gripping assemblies which is usually fixed in an intermittent operation winch. On the other hand, as their name indicates, continuous operation winches have the advantage of yielding continuous movement of a cable on which they act, and so of a load connected thereto.

SUMMARY OF THE INVENTION

The object of the invention is to provide a continuous operation linear hydraulic winch whose length, for equal tractive forces and for equal strokes of the hydraulic jacks, is substantially of the same length as that of known intermittent operation linear hydraulic winches.

To this end, the invention provides a linear hydraulic winch, in which the frame comprises a single bearing plate perpendicular to the hydraulic jacks, the first gripping assembly is disposed on one side of the bearing plate and the second gripping assembly on the other side of said bearing plate, the first and second pairs of hydraulic jacks having one of their cylinders and piston rods connected to said bearing plate and the other of their cylinders and piston rods connected to a respective one of said first and second gripping assemblies.

BRIEF DESCRIPTION OF THE DRAWINGS

The invention will now be described in detail with reference to the accompanying drawingsin which.

DESCRIPTION OF THE PREFERRED EMBODIMENTS OF THE INVENTION

Figure 1:
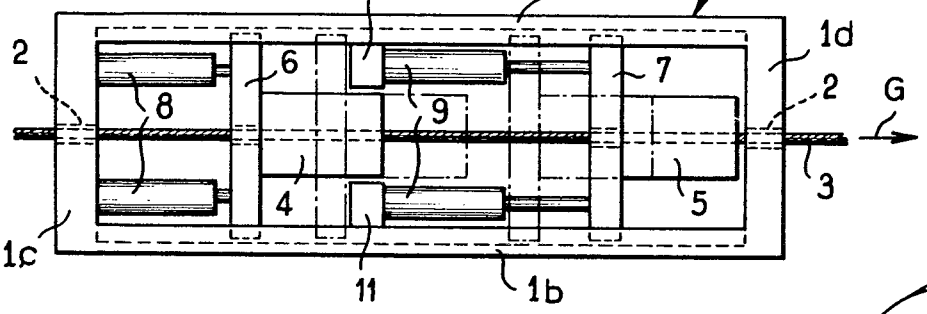
FIG. 1 PRIOR ART
FIG. 1 shows schematically a known continuous operation linear hydraulic winch in an elevational view.

The known linear hydraulic winch shown in FIG. 1 comprise a fixed frame 1, of rectangular shape, formed by two channel-shaped longitudinal members 1*a* and 1*b* braced at their ends by transverse members 1*c* and 1*d* having midlength thereof aligned holes 2 through which a cable 3 passes. Two gripping assemblies 4 and 5 are respectively fixed to movable crosspieces 6 and 7, the ends of which may slide in the longitudinal members 1*a* and 1*b*. Crosspiece 6 may be reciprocated with the gripping assembly 4 by a pair of hydraulic jacks 8, the cylinders of which are fixed to transverse member 1*c*. Similarly, crosspiece 7 may be reciprocated with the gripping assembly 5 associated therewith by means of a pair of hydraulic jacks 9 the cylinders of which are respectively fixed to brackets 11 respectively fixed to the longitudinal members 1*a* and 1*b*. Each of the two gripping assemblies 4 and 5 comprises two wedge-shaped clamping members (not shown) which, when they are selectively clamped against cable 3, cooperate therewith by friction for pulling it.

For pulling cable 3 for example in the direction of arrow G, the two clamping members of the gripping assembly 4 are clamped on cable 3 and the gripping assembly 4 is moved by the two hydraulic jacks 8 in the direction of arrow G while the gripping assembly 5, the two clamping members of which release cable 3, is moved in the direction opposite that of arrow G. When the gripping assemblies 4 and 5 are respectively in the positions shown with dash and dot lines in FIG. 1, the two clamping members of gripping assembly 5 are clamped on cable 3 and gripping assembly 5 is moved in the direction of arrow G, while gripping assembly 4, the two clamping members of which release now cable 3, is moved in the direction opposite that of arrow G, until the two gripping assemblies again occupy the positions shown with a solid line in FIG. 1. Then, the above described cycle is repeated as often as required for moving the load connected to cable 3 by the required amount.

In FIGS. 2 to 8, the elements of the linear hydraulic winch of the present invention, which have the same function as those of the known linear hydraulic winch of FIG. 1 are designated by the same reference numbers. The frame 1 of the linear hydraulic winch of the present invention comprises a single bearing plate 12, perpendicular to the longitudinal axis of cable 3, which has at its center a hole 2 for allowing said cable to pass therethrough.

Figure 5:
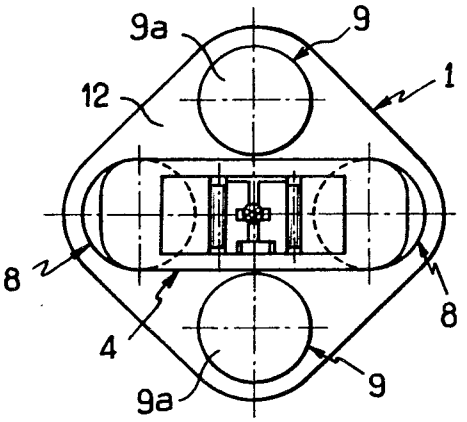
FIG. 5 shows the linear hydraulic winch seen in the direction of arrow F of FIG. 2.
Figure 4:
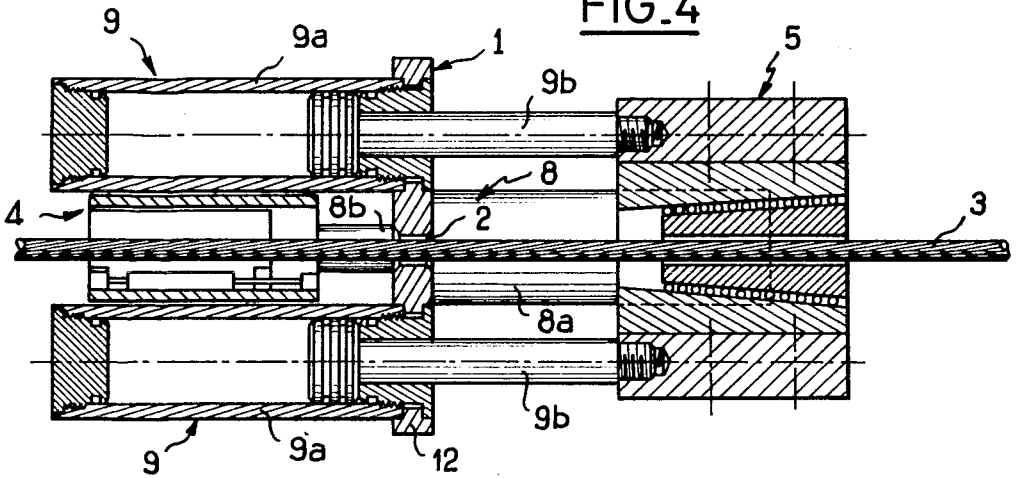
FIG. 4 is a sectional view through line IV—IV of FIG. 3.
Figure 3:
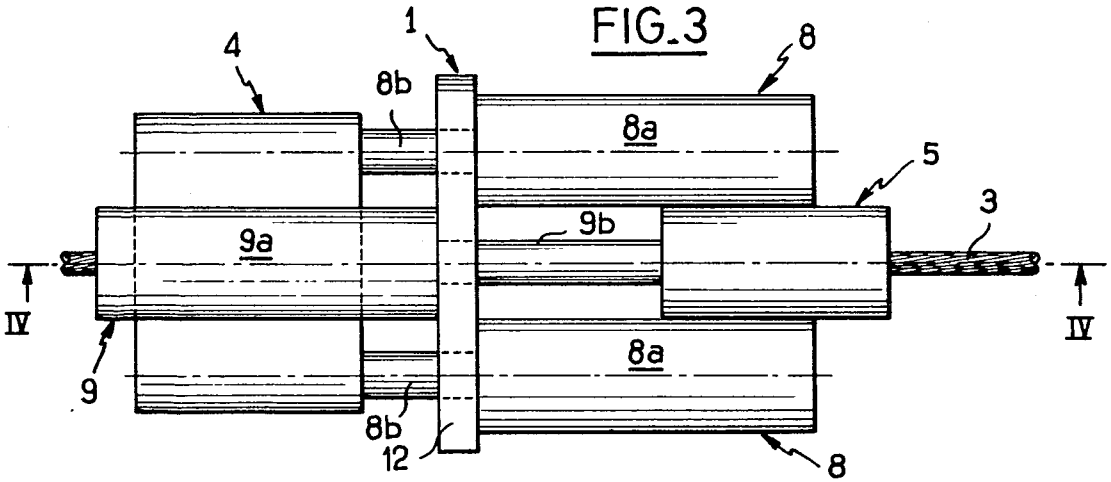
FIG. 3 shows the linear hydraulic winch of FIG. 2 in an elevational view.

The cylinders 8*a* of the two hydraulic jacks 8 and the cylinders 9*a* of the two hydraulic jacks 9 are fixed to the bearing plate 12, the two cylinders 8*a* being situated on one side of said plate and in a first plane perpendicular thereto, whereas the two cylinders 9*a* are situated on the other side of plate 12 in a second plane perpendicular to said plate. Preferably, said first and second planes are also perpendicular to each other as best shown in FIG. 5. The piston rods 8*b* of the two hydraulic jacks 8 pass through the bearing plate 12 and are fixed directly to the gripping assembly 4 which is disposed between the cylinders 9*a* of the two hydraulic jacks 9. Similarly, the piston rods 9*a* of the two hydraulic jacks 9 pass through the bearing plate 12 and are fixed directly to the gripping assembly 5 which is disposed between the cylinders 8*a* of the two hydraulic jacks 8.

With such an arrangement, a continuous operation linear hydraulic winch is obtained which is extremely compact. By way of example, a linear hydraulic winch constructed in accordance with the present invention, having a pulling force of 500 tons and having hydraulic jacks with a stroke of 1.8 meters, has an overall length less than 5 meters. By way of comparison, a known linear hydraulic winch constructed in accordance with FIG. 1, having a pulling force of 500 tons and hydraulic jacks with a stroke of only 1.2 meters has an overall length of about 12 m.

The two gripping assemblies 4 and 5 are identical, so that only one of them will be described with reference to FIGS. 6 to 8. As shown in these Figures, gripping assembly 4 comprises a hcllow body or casing 13 having four walls disposed perpendicularly two by two and defining an elongate passage having a rectangular cross section, in which are disposed two wedge-shaped clamping members 14 between which cable 3 passes. Each of the two clamping members 14 has an outer surface 14*a* which is slanting with respect to the longitudinal axis of cable 3 and can roll, through a set of rollers 15, over the inner surface 16*a* of a bearing piece 16, which is rigidly fixed to body 13 and the inner rolling surface 16*a* of which has a slope identical to that of surface 14*a* of the corresponding clamping member 14. Thus, any relative longitudinal movement of the two clamping members 14 with respect to body 13 causes, depending on the direction of said movement, clamping or unclamping of the cable 3 by said clamping members 14.

Figure 6:
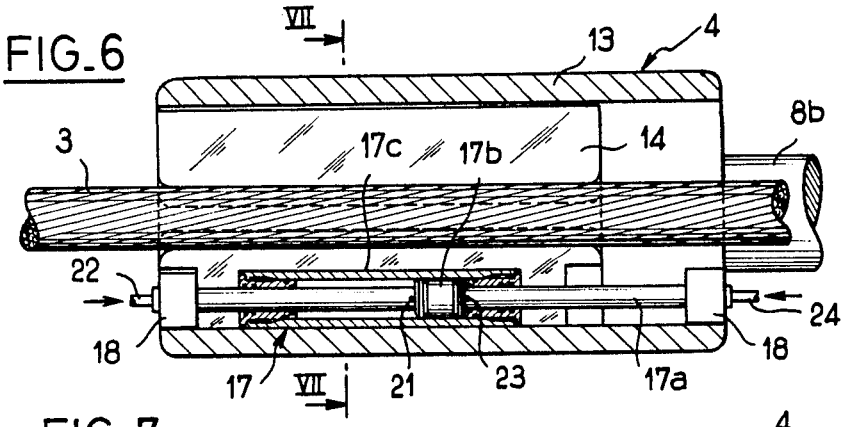
FIG. 6 is an enlarged vertical sectional view of one of the two gripping assemblies of the linear hydraulic winch of FIGS. 2 to 5.
Figure 7:
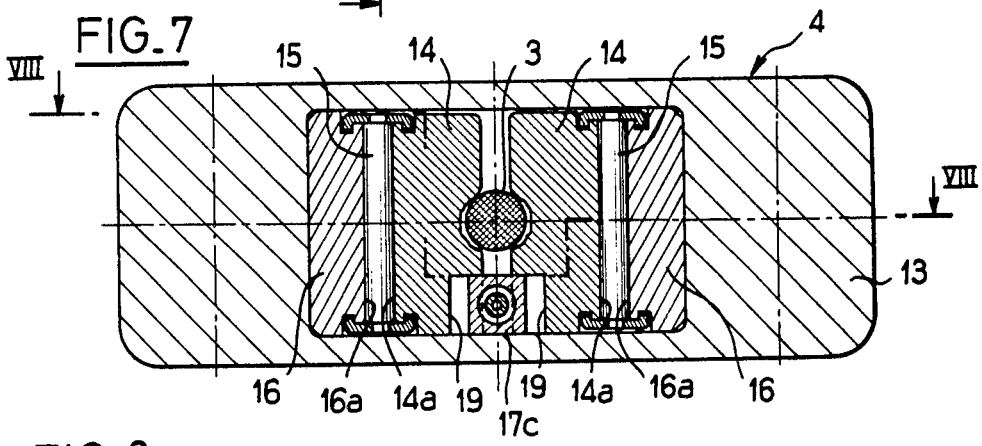
FIG. 7 is a sectional view through lines VII—VII of FIG. 6.
Figure 8:
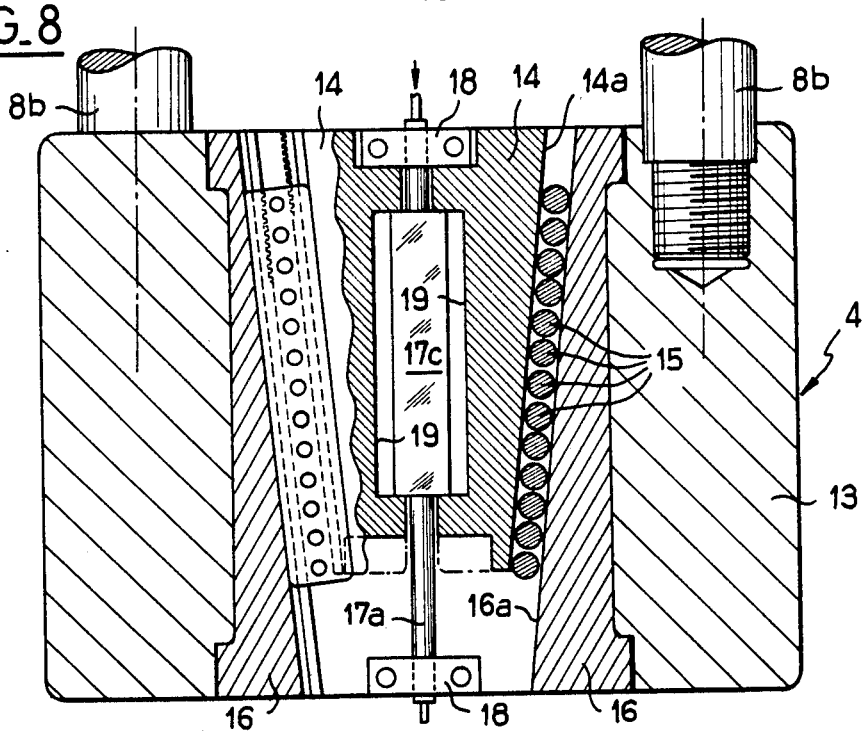
FIG. 8 is a sectional view through line VIII—VIII of FIG. 7.

Means are further provided for synchronizing the movements of the two clamping members 14, for moving them between their respective clamping and unclamping positions shown in FIGS. 6 and 8, and for holding the two clamping members 14 in their unclamping position. Usually, these three functions are performed by separate elements, some at least of which are situated outside of the body of the gripping assembly. According to a preferred embodiment of the present invention, these three functions are performed by a single auxiliary hydraulic jack 17 situated inside body 13 of gripping assembly 4. As shown in FIGS. 6 and 8, the piston rod 17*a* of jack 17 has a length substantially equal to that of body 13 and it is fixed at each of its ends to a block 18 itself fixed rigidly to body 13. In the middle of the piston rod 17*a* is rigidly fixed a piston 17*b*. The "cylinder" 17*c* of jack 17 has a cross section, the outer profile of which has a square shape as best shown in FIG. 7. The "cylinder" 17*c* is partially engaged in two rectangular recesses 19 which face each other and which are respectively formed in the mutually facing inner faces of the clamping members 14. Each of the two recesses 19 has a length equal to that of the "cylinder" 17*c* so that the ends of the latter are in contact with the end faces of recesses 19. A pressurized fluid may be fed into the "cylinder" 17*c*, on the left-hand side of piston 17*b* (seen in FIG. 6), through a hole 21 bored radially in the piston rod 17*a* close to the piston 17*b*, through an axial passage (not shown) in the piston rod 17*a* and through a duct 22 connected to the left end of said piston rod. Similarly, a pressurized fluid mat be fed into the "cylinder" 17*c* on the right-hand side of the piston 17*b* through a hole 23 bored radially in the piston rod 17*a*, through another axial passage (not shown) in the piston rod 17*a* and through a duct 24 connected to the right end of said piston rod. With such an arrangement, when the pressurized fluid is fed into the "cylinder" 17*c* through duct 22, the "cylinder" 17*c* is moved leftward, as seen in FIG. 6, and, because it is fitted in the recesses 19 of the two clamping members 14, it causes said clamping members to move strictly synchronously towards their clamping position. Conversely, when the pressurized fluid is fed into the "cylinder" 17*c* through duct 24, the "cylinder" 17*c* is moved rightward, as seen in FIG. 6, and it causes the two clamping members 14 to move synchronously towards their unclamping position, in which they can be held as long as desired by maintaining the pressure in duct 24.

Figure 9:
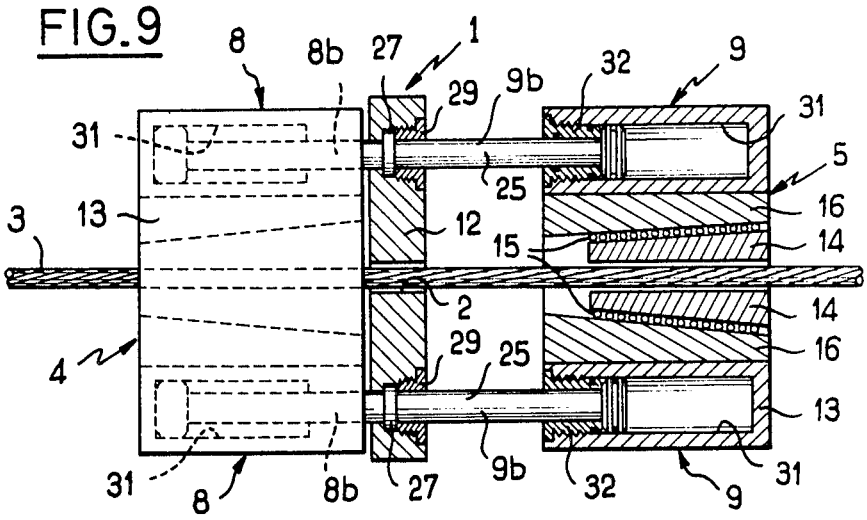
FIGS. 9 to 11 show three other embodiments of the linear hydraulic winch of the present invention.
Figure 10:
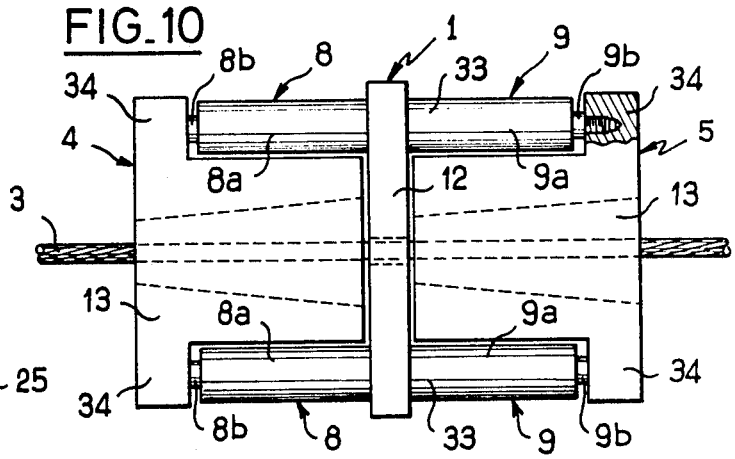
Figure 11:
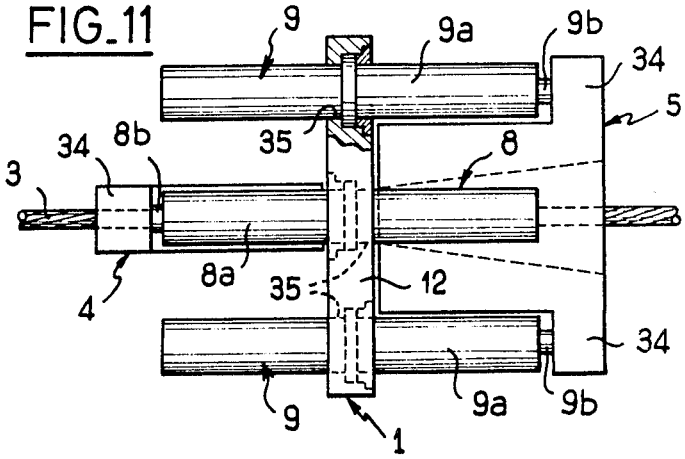

In the three embodiments shown in FIGS. 9 to 11, the elements which are identical or which have the same function as those of FIGS. 2 to 8 are designated by the same reference numbers.

Figure 12:
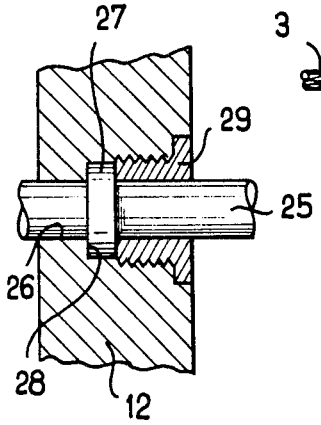
FIG. 12 shows, on a larger scale, a detail of FIG. 9.

In the winches shown in FIGS. 9 and 10, the two gripping assemblies 4 and 5, the first pair of jacks 8 and the second pair of jacks 9 are disposed in a same plane perpendicular to plate 12, the gripping assembly 4 and the two jacks 8 being situated on one side of plate 12, whereas the two jacks 9 and the gripping assembly 5 are situated on the other side of plate 12. In the winch of FIG. 9, the piston rods 8*b* and 9*b* of the four jacks 8 and 9 are fixed to plate 12, whereas in the, winch of FIG. 10, the cylinders 8*a* and 9*a* of the four jacks 8 and 9 are fixed to plate 12. Preferably, in the winch of FIG 9, the piston rods 8*b* of the two jacks 8 are respectively aligned with the piston rods 9*b* of the two jacks 9, and the aligned piston rods 8*b* and 9*b* are formed by a rod 25 which is common to two jacks 8 and 9 and which is fixed at its middle to plate 12. To this end, as best shown in FIG. 12, each rod 25 is engaged through a hole 20 in plate 12 and is provided midlength thereof with an annular flange or collar 27 which is held axially in abutment against a shoulder 28 by means of a threaded ring 29 threadedly engaged in hole 26. In addition, the body 13 of each of the two gripping assemblies 4 and 5 of the winch of FIG. 9 comprises two cylindrical blind holes 31 which are closed, on plate 12 side, by an annular plug 32 serving as a guide for rod 25, and in which the pistons of the two jacks 8 or 9 slide, respectively. In other words, the cylinders of jacks 8 and the cylinders of jacks 9 are integral with the body 13 of the gripping assemblies 4 and 5, respectively.

Similarly, the cylinders 8*a* of the two jacks 8 of the winch of FIG. 10 are respectively aligned with the cylinders 9*a* of the two jacks 9, and the aligned cylinders are formed by a hollow cylindrical body 33, which is common to two jacks 8 and 9 and which is fixed at its middle to plate 12 by means similar to those shown in FIG. 12 and already described in connection with rod 25. The inner bore of the cylindrical body 33 is provided midlength thereof with a transverse partition wall (not shown) separating the chambers of the two jacks 8 and 9. Furthermore, in the winch of FIG. 10, the body 13 of each of the two gripping assemblies 4 and 5 comprises, at its end remote from plate 12, two projecting portions 34 which extend laterally in opposite directions and to which the piston rods 8*b* or 9*b* of jacks 8 or 9 are respectively fixed.

Figure 2:
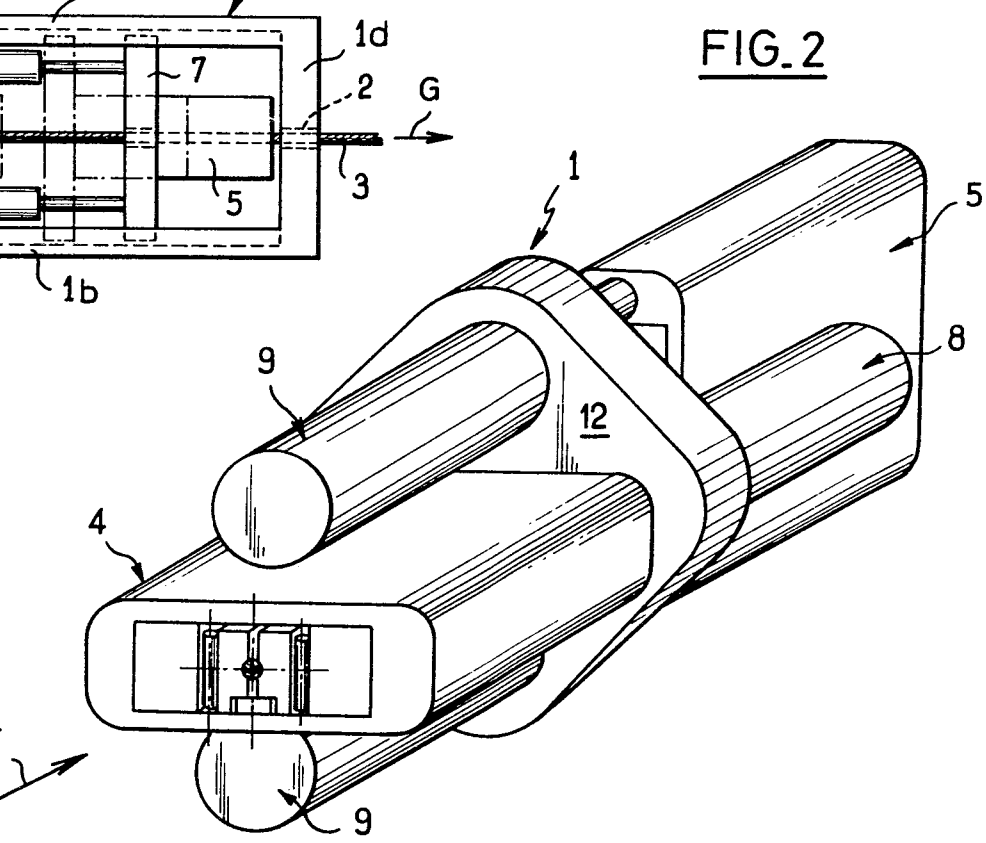
FIG. 2 shows a first embodiment of the linear hydraulic winch of the present invention in a perspective view.

In the winch shown in FIG. 11, the two gripping assemblies 4 and 5, the two jacks 8 and the two jacks 9 are disposed in a way similar to that shown in FIG. 2, but the four jacks 8 and 9 are longer. In this case, cylinders 8*a* and 9*a* of the jacks pass through holes 35 in plate 12 and are fixed substantially at their middle to said plate 12 by means similar to those shown in FIG. 12 and already described in connection with rod 25. In addition, the piston rods 8*b* and 9*b* of jacks 8 and 9 of the winch shown in FIG. 11 are fixed to laterally projecting portions 34 of the body of gripping assemblies 4 and 5, respectively, in a way similar to that shown in FIG. 10.

Although not shown in FIGS. 9 to 11, each of the two gripping assemblies 4 and 5 may comprise an auxiliary jack similar to jack 17 shown in FIGS. 6 to 8, for synchronously moving the clamping members 14 between their clamping and unclamping positions.

It goes without saying that the embodiments of the present invention which have been described above have been given solely by way of examples and are in no wise limitative, and that numerous modifications may be readily made by a man skilled in the art without departing from the scope and spirit of the present invention. Thus, instead of being in the form of a molded block, the body 13 of each of the two gripping assemblies 4 and 5 may be formed by several elements assembled together as known in the art.

What is claimed is:

1. A continuous operation linear hydraulic winch, comprising a fixed frame, a first gripping assembly, a first pair of parallely disposed hydraulic jacks mounted between the frame and the first gripping assembly, a second gripping assembly, and a second pair of parallely disposed hydraulic jacks extending in a same direction as said first pair of jacks and mounted between the frame and the second gripping assembly, wherein said frame comprises a single bearing plate perpendicular to said jacks, said first gripping assembly is disposed on one side of said bearing plate and the second gripping assembly on the other side of said bearing plate, said first and second pairs of hydraulic jacks having one of their cylinders and piston rods connected to said bearing plate and the other of their cylinders and piston rods connected to a respective one of said first and second gripping assemblies.

2. The linear hydraulic winch as claimed in claim 1, wherein said first pair of hydraulic jacks is disposed in a first plane perpendicular to said bearing plate, the second pair of hydraulic jacks is disposed in a second plane perpendicular to said bearing plate, the piston rods of each pair of hydraulic jacks are fixed to the gripping assembly associated therewith, whereas the cylinders of each pair of hydraulic jacks are fixed to the bearing plate and extend at least partially on an opposite side of said plate with respect to the gripping assembly associated therewith, and each of said first and second gripping assemblies is disposed between the cylinders of the pair of hydraulic jacks associated with the other of said gripping assemblies.

3. The linear hydraulic winch as claimed in claim 2, wherein the cylinders of each pair of hydraulic jacks are situated entirely on the opposite side of said bearing plate with respect to the gripping assembly associated therewith.

4. The linear hydraulic winch as claimed in claim 2, wherein the cylinders of each pair of hydraulic jacks pass through holes in said bearing plate and are fixed substantially at their middle to said plate, and each of said first and second gripping assemblies comprises a body having, at its end remote from said bearing plate, two projecting portions which extend laterally in opposite directions and to which the piston rods of the associated pair of the hydraulic jacks are fixed.

5. The linear hydraulic winch as claimed in claim 2, wherein said second plane is perpendicular to said first plane.

6. The linear hydraulic winch as claimed in claim 1, wherein said first and second gripping assemblies and said first and second pairs of hydraulic jacks are disposed in a same plane perpendicular to said bearing plate, said first gripping assembly and said first pair of hydraulic jacks being situated on one side of said bearing plate, whereas said second gripping assembly and said second pair of hydraulic jacks are situated on the other side of said bearing plate.

7. The linear hydraulic winch as claimed in claim 6, wherein the piston rods of the four hydraulic jacks are fixed to said bearing plate.

8. The linear hydraulic winch as claimed in claim 7, wherein the piston rods of said first pair of hydraulic jacks are respectively aligned with the piston rods of said second pair of hydraulic jacks, and the aligned piston rods are formed by a rod which is common to two hydraulic jacks respectively of the first and of the second pair of hydraulic jacks and which is fixed at its middle to said bearing plate.

9. The linear hydraulic winch as claimed in claim 8, wherein each of said first and second gripping assemblies comprises a body, and the cylinders of each of said first and second pairs of hydraulic jacks are integral with the body of the associated gripping assembly.

10. The linear winch as claimed in claim 6, wherein the cylinders of the four hydraulic jacks are fixed to said bearing plate.

11. The linear hydraulic winch as claimed in claim 10, wherein the cylinders of said first pair of hydraulic jacks are respectively aligned with the cylinders of said second pair of hydraulic jacks, and the aligned cylinders are formed by a hollow cylindrical body which is common to two hydraulic jacks respectively of said first and said second pair of hydraulic jacks and which is fixed at its middle to said bearing plate.

12. The linear hydraulic winch as claimed in claim 10, wherein each of said first and second gripping assemblies comprises a body having, at its end remote from said bearing plate, two projecting portions which extend laterally in opposite directions and to which the piston rods of the associated pair of hydraulic jacks are fixed.

13. The linear hydraulic winch as claimed in claim 11, wherein each of said first and second gripping assemblies comprises a body having, at its end remote from said bearing plate, two projecting portions which extend laterally in opposite directions and to which the piston rods of the associated pair of hydraulic jacks are fixed.

14. The linear hydraulic winch as claimed in claim 1, wherein each of said first and second gripping assemblies comprises an elongated hollow body having two opposite inner faces slanting with respect to the longitudinal axis of said body, and two wedge-shaped clamping members, disposed in said hollow body and each having an outer face having a slant corresponding to the slant of one of said two inner faces of the body, so that a relative longitudinal movement of said two clamping members with respect to said body causes, depending on the direction of said relative movement, said clamping members to clamp or release a cable with which the hydraulic winch is intended to cooperate, and wherein each of said first and second gripping assemblies further comprises an auxiliary hydraulic jack having a cylinder which is partially fitted in two mutually facing recesses, formed respectively in mutually facing inner faces of said two clamping members and having a length equal to that of the cylinder of the auxiliary hydraulic jack, said auxiliary hydraulic jack having a piston rod which is fixed, at each end thereof, to the body of said gripping assembly.

* * * * *